US006758906B2

(12) United States Patent
Maiwald et al.

(10) Patent No.: US 6,758,906 B2
(45) Date of Patent: Jul. 6, 2004

(54) METHOD OF AND APPARATUS FOR APPLYING ADHESIVE TO WEBS OF WRAPPING MATERIAL

(75) Inventors: Berthold Maiwald, Marschacht (DE); Torsten Mörke, Dissau (DE); Karl-Heinz Pawelko, Schwarzenbek (DE)

(73) Assignee: Hauni Mashinenbau AG, Hamburg (DE)

( * ) Notice: Subject to any disclaimer, the term of this patent is extended or adjusted under 35 U.S.C. 154(b) by 256 days.

(21) Appl. No.: 09/838,130

(22) Filed: Apr. 20, 2001

(65) Prior Publication Data

US 2001/0032697 A1 Oct. 25, 2001

(30) Foreign Application Priority Data

| | | |
|---|---|---|
| Apr. 20, 2000 | (DE) | 100 19 930 |
| Mar. 13, 2001 | (EP) | 01106122 |
| Apr. 12, 2001 | (EP) | 01109094 |

(51) Int. Cl.[7] ..... B05C 5/02

(52) U.S. Cl. ..... 118/315; 118/325; 118/411; 118/412; 118/419; 156/578

(58) Field of Search ..... 118/315, 325, 118/410–412, 419; 427/207.1, 356; 156/578; 239/290, 581.1, 99

(56) References Cited

U.S. PATENT DOCUMENTS

| | | | | |
|---|---|---|---|---|
| 4,119,058 A | * | 10/1978 | Schmermund | 118/411 |
| 4,121,595 A | | 10/1978 | Heitmann et al. | |
| 4,257,562 A | | 3/1981 | Zini | |
| 4,281,670 A | | 8/1981 | Heitmann et al. | |
| 4,282,889 A | | 8/1981 | Dahlgrün | |
| 4,412,505 A | | 11/1983 | Häusler et al. | |
| 4,825,882 A | | 5/1989 | Hinz | |
| 4,889,140 A | | 12/1989 | Lorenzen et al. | |
| 5,060,668 A | | 10/1991 | Weinhold | |
| 5,135,008 A | | 8/1992 | Oesterling et al. | |
| 5,221,350 A | | 6/1993 | Tallier et al. | |
| 5,360,516 A | * | 11/1994 | Cutright et al. | 162/139 |
| 5,766,121 A | * | 6/1998 | Spada | 493/150 |
| 5,769,947 A | | 6/1998 | Krappweis | |
| 5,895,553 A | * | 4/1999 | Spada | 156/543 |
| 6,024,299 A | | 2/2000 | Drozkowski | 239/290 |

FOREIGN PATENT DOCUMENTS

| | | |
|---|---|---|
| DE | 10 10 891 | 6/1957 |
| DE | 1 241 323 | 3/1967 |
| DE | 28 45 342 | 4/1980 |
| DE | 2 056 321 | 3/1981 |
| DE | 39 09 990 | 9/1990 |
| DE | 198 06 673 | 8/1998 |
| DE | 197 14 029 | 10/1998 |
| EP | 0 300 734 | 1/1989 |
| EP | 1 147 716 | 10/2001 |
| FR | 791 988 | 12/1935 |
| GB | 458 443 | 12/1936 |

* cited by examiner

*Primary Examiner*—Laura Edwards
(74) *Attorney, Agent, or Firm*—Venable LLP; Robert Kinberg; Chad C. Anderson

(57) ABSTRACT

Apparatus for the application of adhesive to one side of a running web of tipping paper for use in filter cigarete makers has a single source of adhesive or two or more sources containing identical or different adhesives, and one or more conduits leading from the source(s) to one or more nozzles which applies or apply one or more films of a single adhesive or of different adhesives to selected portions of the one side of the web. The rate of admission of adhesive(s) to the nozzle(s), including interruption and restarting of admission of adhesive(s), is regulated by one or more valves each having a body receiving a rotary valving element provided with one or more peripheral projections and/or recesses serving to regulate the rate of flow of adhesive toward the single nozzle or the respective nozzles. The rotary elements of two or more valves can constitute disc-shaped sections of a single rotor confined in a valve body common to all valves. The adhesive or at least one of two or more different adhesives being applied to the web can contain one or more taste- and/or odor- and or flammability influencing agents.

31 Claims, 6 Drawing Sheets

METHOD OF AND APPARATUS FOR APPLYING ADHESIVE TO WEBS OF WRAPPING MATERIAL

The present application claims the priority of the commonly owned German patent application Serial No. 100 19 930.5 filed Apr. 20, 2000 and commonly owned European patent application Serial No. 01106122.3 filed Mar. 13, 2001. The disclosures of the above-referenced priority applications, as well as that of each US and foreign patent and patent application identified in the specification of the present application, is incorporated herein by reference.

BACKGROUND OF THE INVENTION

The invention relates to improvements in methods of and in apparatus for applying flowable adhesives to running strips or webs of paper or the like. More particularly, the invention relates to improvements in methods and in apparatus which can be resorted to with advantage in connection with the application of adhesive to running strips or webs (hereinafter called webs for short) of wrapping material of the type utilized in connection with the making and processing of smokers' products.

Examples of webs of wrapping material which must be provided with layers or films of special adhesive and/or with layers or films containing different types of adhesive are those which are employed for the assembly of filter rod sections with plain cigarettes to form filter cigarettes of unit length or multiple unit length. Wrapping material of such character is known as tipping paper and is utilized in machines known as filter cigarette makers or tipping machines. Examples of such machines are those known worldwise as MAX (distributed by the assignee of the present application). A MAX machine is designed to assemble successive groups of coaxial plain cigarettes and filter rod sections of unit length or multiple unit length, to connect the constituents of such groups with each other by resorting to so-called uniting bands (sections of a web of tipping paper one side of which carries a continuous or composite film of adhesive) which are convoluted around the filter rod sectons and the adjacent end portions of plain cigarettes, and to thereafter sever the groups to obtain filter cigarettes of unit length.

German patent No. 24 45 342 C2 discloses a machine which can change the quantity of adhesive being applied to successive still coherent uniting bands of tipping paper, i.e., prior to separation of successive foremost uniting bands from the leader of a running web of tipping paper. The quantity of adhesive per uniting band is changed by reducing or increasing the thickness of the film of applied adhesive and/or by changing the area(s) of the adhesive-coated portion(s) of each uniting band. The purpose of changing the quantity of adhesive per uniting band is to properly relate the quantity of applied adhesive to the permeability of the web of tipping paper and/or to properly relate the quantity of adhesive to the force with which certain portions of a uniting band must adhere to the filter mouthpiece, to the plain cigarette and/or both. The patented machine is further provided with means for intermittently interrupting the application of adhesive to the running web of tipping paper. This is accomplished by resorting to a rotary cam the RPM of which is related to the speed of the running web of tipping paper and which serves to alternatingly move the running web toward and away from the adhesive applying nozzle.

The patented apparatus exhibits certain drawbacks, especially as far as its versatility is concerned. For example, the patented apparatus applies adhesive to those portions of the running web which are not to be bonded to constituents of filter cigarettes. Furthermore, the patented apparatus increases the rate of application of adhesive immediately subsequent to each interruption of transfer of adhesive to the running web of tipping paper.

The aforementioned German patent also discloses a method of applying adhesive to a running web of tipping paper. The method involves the utilization of at least one nozzle with an orifice which discharges adhesive into contact with the running web of tipping paper. The method does not take into consideration the possibility of injury to a smoker, e.g., when the filter cigarette is smoked all the way to the end of the tobacco-containing part (i.e., to the end of the plain cigarette forming part of the filter cigarette). Combustion of the inner end of the tobacco-containing part of the filter cigarette can result in the development of flame (due to combustion of adhesive which forms part of the adhesive coat on the inner side of the convoluted uniting band), and such flame can cause injury to and can frighten the smoker. Moreover, once the tobacco-containing part of a filter cigarette is combusted close or very close to the end portion which is surrounded by the respective terminal portion of the convoluted uniting band, the glowing remaining part of the tobacco-containing portion is likely to fall to the floor or onto a chair or table or suit or dress with resulting damage to the carpet, to the piece of furniture or to the clothing and the danger of fire.

A further drawback of the patented method and apparatus is that the accuracy and predictability of the application of adhesive decrease when a tipping machine turns out filter cigarettes at a rate which can be achieved by resorting to modern high-speed tipping machines. This results in the making of a high percentage of rejects as well as in customer complaints.

OBJECTS OF THE INVENTION

An object of the present invention is to increase the predictability of the application of adhesive to running webs of wrapping material, such as tipping paper which is utilized in filter cigarette making machines.

Another object of our invention is to provide a method which can be resorted to for the application of adhesive to a running web of tipping paper or the like and which renders it possible to economize with the adhesive regardless of the complexity of the pattern which is formed by applied adhesive at one side of the web.

A further object of the invention is to provide a method which renders it possible to accurately select and/or alter the pattern formed by the adhesive at one side of a web of tipping paper or the like.

An additional object of the invention is to provide a method which renders it possible to impart to the adhesive desirable qualities and/or characteristics which were not known up to this time and/or which cannot be achieved by resorting to heretofore known and practiced methods.

Still another object of the instant invention is to provide a method which renders it possible to greatly reduce the likelihood of injury to and/or startling of the smoker as well as the possibility of damage to furniture, carpeting and/or clothing at the location(s) where filter cigarettes are being smoked in offices, at homes and/or elsewhere.

A further object of the invention is to provide a novel and improved apparatus for the application of flowable adhesive to running webs of paper or the like, such as webs of tipping paper for use in filter cigarette making machines.

Another object of the invention is to provide an apparatus which can properly and predictably apply one or more types of adhesive to a running web of tipping paper in modern high-speed tipping and/or analogous machines for the making of filter cigarettes, other smokers' products (such as cartons or packets for smokers' products), or products which are not classifiable as smokers' products but do employ or require the application of accurate patterns of adhesive substance(s) onto running webs of wrapping or other absorbent and/or foraminous material.

An additional object of the invention is to provide an apparatus which can be readily adjusted or converted for the application of one, two or more types of adhesive to different webs of adhesively bondable material and which can be installed in existing machines (such as the aforementioned tipping machines) for the making of various products including but not limited to smokers' products.

A further object of this invention is to provide rod-shaped smokers' products which are safer, more pleasing to the eye and tastier to smokers than heretofore known smokers' products.

Still another object of the invention is to provide an apparatus which exhibits the above-enumerated features and advantages, which can be utilized for the making of the aforementioned superior products, and which can be installed in or incorporated into existing mass-producing machines or productino lines.

A further object of the invention is to provide an apparatus which can interrupt and/or restart the application of adhesive to running webs of paper, tipping paper or the like with a degree of accuracy and predictability not achievable with presently known apparatus.

Another object of the invention is to provide an apparatus which can apply simple, complex or highly complex patterns of adhesive to a running web of paper or the like in such a way that the web is not induced or compelled to perform undesirable fluttering and/or other stray movements even when the application of adhesive takes place at a rate which is required in modern high-speed tipping machines or the like.

An additional object of the invention is to provide an apparatus which can repeatedly apply a pattern of adhesive films to one side of a running web of paper or the like in such a way that the quality of the pattern is higher than those achievable with conventional apparatus because the application of patterns is not affected by those irregularities of transport of the web which necessarily or normally develop in conventional apparatus.

A further object of the invention is to provide novel and improved filter cigarettes, filter cigars and analogous rod-shaped smokers' products.

An additional object of the invention is to provide novel and improved valves for use in the above outlined apparatus.

SUMMARY OF THE INVENTION

One of several features of the present invention resides in the provision of an apparatus which is designed to apply a flowable adhesive to selected portions of a running web of wrapping material, especially a wrapping material of the type utilized in connection with the making of smokers' products. A typical example of such wrapping material is so-called tipping paper which is to be subdivided into relatively short sections called uniting bands serving to connect filter mouthpieces with plain cigarettes in a filter cigarette making machine (also called tipping machine).

The improved apparatus comprises at least one source of adhesive (e.g., a tank), an applicator including at least one nozzle and having at least one adhesive-discharging orifice adjacent a course or path (hereinafter called course) for the running web, means (such as one or more groups of interconnected conduits, channels or the like) for connecting the at least one source with the applicator, and means for regulating (such regulation includes interrupting) the flow of adhesive in the connecting means. In accordance with an important and highly advantageous feature of the invention, the connecting means comprises at least one rotary valve, particularly a valve of the type wherein at least one rotor is confined in and can turn relative to a stator to thereby increase or reduce the rate of adhesive flow or to interrupt the flow of adhesive from the source to the applicator.

In a presently preferred embodiment, the at least one valve includes a valve body (stator) and at least one rotor which is disposed in and has a peripheral surface defining with the valve body at least one arcuate path for the flow of adhesive from the inlet to the outlet of the at least one valve. The peripheral surface of the rotor exhibits at least one irregularity or unevenness which is arranged to influence the flow of adhesive from the inlet to the outlet of the at least one valve. The at least one irregularity can include a recess (such as a groove) and/or at least one projection (e.g., a lobe or the like). The valve body can include or constitute a housing defining a chamber for the at least one rotor.

The applicator (such as the aforementioned nozzle) can be provided with at least one adhesive-storing chamber which communicates with the at least one orifice and can be resorted to for the purpose of regulating the quantity of adhesive being applied to unit lengths of one side of the running web. Similar or analogous results can be obtained by utilizing a nozzle with an orifice having a variable depth and/or capacity and/or another parameter which, if changed, influences the quantity of adhesive being applied to the web by the thus constructed applicator. In other words, the orifice(s) of the nozzle or nozzles is or are adjustable. For example, the arrangement can be such that the overall width of the applicator and/or of the orifice is adjustable.

The applicator, such as the nozzle(s) or a carrier for the nozzle(s), can be provided with an arcuate (such as convex) web-contacting surface which is adjacent a portion of the course for the web.

The apparatus is preferably provided with means (such as one or more pumps) which serves to adjust (such as vary) the pressure of adhesive in the connecting means.

The applicator can include or be constituted by a plurality of nozzles each having at least one adhesive-discharging orifice adjacent the course for the web. The connecting means of such apparatus can include discrete conduits each of which connects the at least one source (or a selected one of several sources) with a different nozzle. Such apparatus can further comprise means (such as two or more pumps) for individually selecting the pressure of adhesive in at least two conduits.

For example, the applicator can include at least two nozzles each having at least one adhesive-discharging orifice adjacent the course for the running web. The connecting means of such apparatus can include at least two conduits each of which connects the at least one source with a different nozzle, and the apparatus further comprises means (such as one or more pumps) for maintaining the pressure of adhesive in one of the at least two conduits at a value or level which at least approximates the pressure of adhesive in the other conduit. The connecting means can further include an additional conduit which communicates with the at least one source, and the at least two conduits have inlets which communicate with the additional conduit; the pressure maintaining means can include at least one pump which is disposed in the additional conduit upstream of the inlets of the at least two conduits.

At least a portion (e.g., at least one of several nozzles) of the applicator can be provided with a coat of a material which opposes (such as prevents) accumulations of adhesive on the applicator; this reduces the likelihood of clogging of one or more orifices and the resulting departure of actual rate of application of adhesive to one side of the running web from the desired or required rate of application.

In accordance with a desirable and advantageous additional feature of the invention, the apparatus further comprises means (such as one or more sensors and/or detectors) for monitoring at least one variable parameter of adhesive on the web. For example, the monitoring means can include means for ascertaining the quantity of adhesive being applied to the web. Alternatively, or in addition to such quantity-ascertaining monitoring means, the monitoring means can include means for generating signals denoting the monitored parameter(s) and the apparatus can further comprise means for adjusting the source and/or the applicator and/or the connecting means and/or the regulating means in response to (e.g., as a function of) such signals.

If the applicator comprises a plurality of nozzles each of which has at least one orifice, the regulating means of such apparatus can comprise a rotary valve for each nozzle. Each valve can include a valve body and a rotor which is disposed in and has a peripheral surface defining with the valve body at least one arcuate path for the flow of adhesive from the inlet to the outlet of the respective valve. The peripheral surface of each rotor can be provided with at least one irregularity (such as the aforementioned recess(es) and/or projection(s)) serving to influence the flow of adhesive from the inlet to the outlet of the respective valve. Each peripheral surface, or at least one of the peripheral surfaces, can be provided with two or more irregularities (e.g., with a projection and with a recess which at least partially surrounds the projection).

The improved apparatus or the machine which embodies or cooperates with such apparatus is provided with means for advancing the web along its course at a first speed, and with means for rotating (e.g., indexing) the rotor or rotors of the valve or valves forming part of the regulating means at a second speed. Such apparatus can further comprise means for synchronizing the operation of the advancing means with that of the rotating means.

The improved apparatus can comprise at least two sources of adhesive, e.g., a first source containing a first adhesive and a second source containing a different second adhesive. The applicator of such apparatus can comprise first and second nozzles each of which has at least one orifice adjacent the course for the web, and the connecting means of such apparatus can include at least one first conduit which serves to convey first adhesive from the respective (first) source to the first nozzle and at least one second conduit which serves to convey second adhesive from the respective (second) source to the second nozzle.

A presently preferred rotary valve of the improved apparatus can include a hollow stator and a rotor which is rotatable (such as indexible) in the stator about a predetermined axis. The stator and the rotor define an arcuate groove which is disposed in a plane normal to the predetermined axis and extending from the inlet to the outlet of the valve. The groove can extend along an arc which is close to but is less than 360°.

The applicator of the improved apparatus can comprise a plurality of nozzles each of which is provided with at least one orifice and each of which is adjacent a different portion of the course for the running web. The connecting means of such apparatus can include a plurality of conduits, at least one for each of the nozzles and each connecting the source or one of several sources with the respective nozzle. For example, the source of such apparatus can include a plurality of discrete sources of different adhesives, and the aforementioned conduits can include at least two conduits connecting one of the discrete sources with the respective nozzles. The regulating means of such apparatus can include a plurality of valves each of which has a hollow body and a rotor which is turnable in the respective body about a predetermined axis; the peripheral surface of each rotor defines with the respective valve body a path leading to one of the nozzles, and the valve bodies co-operate with the respective rotors to confine the adhesive to flow along the prescribed paths, namely to the respective nozzles.

The rotors of valves in the just discussed apparatus can constitute disc-shaped sections of a rotor which is common to all valves of the regulating means. Furthermore, the hollow bodies preferably form part of a stator which is common to and surrounds all of the disc-shaped sections, and the peripheral surface of each disc-shaped section can be provided with at least one irregularity which serves to influence the flow of adhesive within the respective hollow body.

At least one of the disc-shaped sections can cooperate with the respective hollow body to establish a seal against leakage of adhesive from the respective valve. Still further, the internal surfaces of such hollow bodies (i.e., the surfaces surrounding the respective rotors) can be provided with arcuate grooves for the flow of adhesive along the respective paths; the centers of curvature of such grooves are or can be disposed on the predetermined axis. Each such groove can extend along an arc which approximates but is less than 360°. As already mentioned hereinbefore, at least one of the nozzles can be provided with at least one adhesive-storing chamber which communicates with the respective orifice.

Another feature of the invention resides in the provision of a method of applying adhesive to selected portions of one side of a web, particularly a web of wrapping material for smokers' products. The improved method comprises the steps of advancing the web lengthwise along a predetermined course, placing first and second nozzles adjacent the one side of the web in a predetermined portion of the course, establishing first and second sources respectively containing first and second flowable adhesives, conveying adhesives from the first and second sources to the first and second nozzles, and utilizing the first and second nozzles for the application of first and second adhesives to the selected portions of one side of the web in the course.

The conveying step can include inducing the flow of first and second adhesives to the respective nozzles along discrete first and second paths, and the utilizing step can include intermittently applying at least one of the adhesives to the one side of the web in its course. Such step of intermittently applying at least one of the adhesives can include regulating the flow of the at least one adhesive by a rotary valve. The conveying step can be carried out by utilizing at least one pump for each of the first and second adhesives. In accordance with a presently preferred embodiment, the conveying step includes conveying the first and second adhesives along discrete first and second paths, and such method can further comprise the step of introducing into the adhesive at least one additive (such as a flavoring agent and/or a substance which prevents adhesive from adhering to parts of the valve(s) and/or nozzle(s)) in at least one of the first and second paths.

A further feature of our invention resides in the provision of a method of making rod-shaped smokers' products wherein a tubular envelope confines smokable material and at least a portion of the envelope consists of a section of a web of paper or the like one side of which is at least partially coated with at least one film of an adhesive. This method comprises the steps of advancing the web lengthwise along a predetermined course, establishing at least one source of flowable adhesive, positioning an orifice of at least one nozzle adjacent a portion of the course at one side of the advancing web, conveying adhesive along at least one path extending from the at least one source to the at least one nozzle, and regulating the flow of adhesive in the at least one path. This regulating step includes employing at least one rotary valve.

An additional feature of the invention resides in the provision of a method of making rod-shaped smokers' products wherein a tubular envelope confines a smokable material and at least a portion of the envelope consists of a section of a web one side of which is at least partially coated with at least one film of adhesive. This method comprises the steps of advancing the web lengthwise along a predetermined course, positioning the orifices of at least two nozzles adjacent a portion of the course at one side of the web, establishing at least two sources of flowable adhesive, and conveying flowable adhesive from each of the sources along a discrete path to a different one of the nozzles. Such method can further comprise the step of maintaining the adhesives in the paths at different pressures.

Another feature of the present invention resides in the provision of a novel article of manufacture which is a rod-shaped smokable product including a smokable filler and a tubular envelope consisting at least in part of a section of a web having one side at least partially coated with at least one film of adhesive. The at least one film contains at least two different types of adhesive.

At least one of the two or more different types of adhesive can consist, at least in part, of a combustion retarding material. Furthermore, at least one of the adhesives can contain a flavoring agent.

The filler can consist of cigarette tobacco and a filter mouthpiece, i.e., the smokable product can constitute a filter cigarette.

The aforementioned section of the web can constitute a convoluted uniting band of tipping paper which serves to attach one end portion of a plain cigarette to one end portion of a filter mouthpiece. Such band can include a first annular portion which is at least partially coated with adhesive containing at least one flavoring agent, and a second annular portion at least partially coated with adhesive consisting of or containing a combustion retarding material.

The novel features which are considered as characteristic of the invention are set forth in particular in the appended claims. The improved apparatus itself, however, both as to its construction and the modes of assembling, installing and utilizing the same, together with numerous additional important and advantageous features and attributes thereof, will be best understood upon perusal of the following detailed description of certain presently preferred specific embodiments with reference to the accompanying drawings.

DESCRIPTION OF PREFERRED EMBODIMENTS

Figure 1:
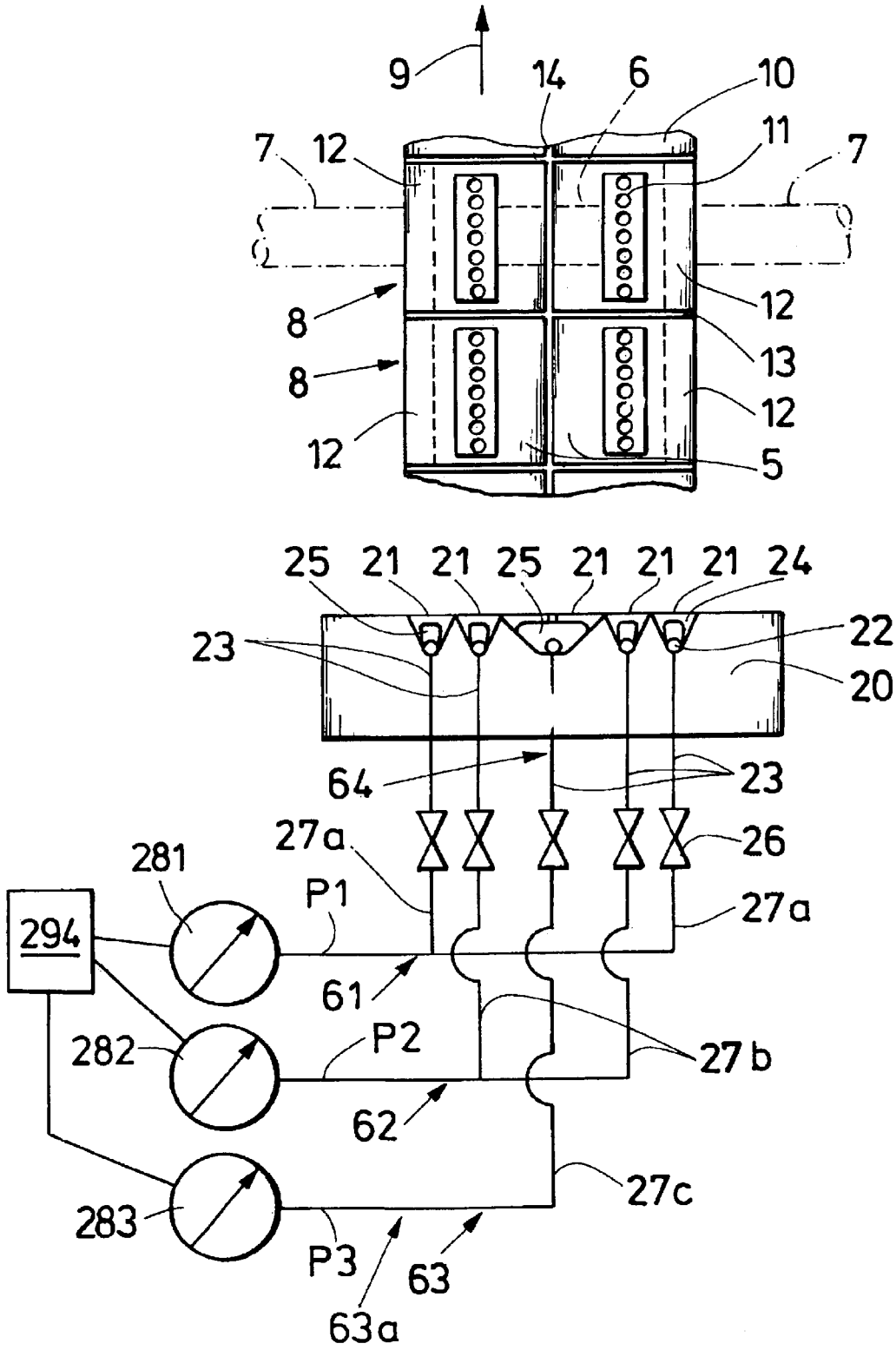
FIG. 1 is a schematic exploded view of a web of tipping paper and of certain parts of one embodiment of an apparatus which can be utilized to apply films of adhesive to selected portions of one side of the web.

FIG. 1 shows a portion of an apparatus which embodies one form of the present invention. The character 10 denotes an elongated web of wrapping material, e.g., a web of paper which is to be subdivided into a series of successive so-called uniting bands 8 serving to be convoluted about abutting end portions of plain cigarettes 7 and filter rod sections 6 to form filter cigarettes of double unit length. For example, the web 10 can be subdivided into uniting bands 8 of the type formed in a so-called tipping (filter rod making) machine described and shown in commonly owned U.S. Pat. No. 5,135,008 granted Aug. 4, 1992 to Oesterling et al. for "METHOD OF AND APPARATUS FOR MAKING FILTER CIGARETTES".

The patent to Oesterling et al. shows the details of a tipping machine wherein successive uniting bands (obtained upon repeated severing of the leader of a continuous web of tipping paper) are convoluted around successive filter rod sections of double unit length and the adjacent end portions of two plain cigarettes of unit length which flank the respective filter rod sections of double unit length and are coaxial therewith. The thus obtained filter cigarettes of double unit length are severed midway across the convoluted uniting bands of double unit length to yield pairs of filter cigarettes of unit length. One side of the running web of tipping paper is coated with a suitable adhesive prior to the subdividing step, and the web and/or the wrapper of each finished filter cigarette of unit length or double unit length is or can be perforated (if necessary) in order to increase the permeability of the tubular wrappers of such smokers' products.

The web 10 which is shown in the upper portion of FIG. 1 is assumed to advance (stepwise or continuously) along a course or path wherein it advances in the direction indicated by arrow 9. The illustrated web 10 is composed of a series of successive uniting bands 8 each of which is provided with two longitudinally extending parallel rows of perforations 11. When the application of one or more suitable adhesives to selected areas of one side of each successive future uniting band 8 is completed, successive foremost uniting bands are separated from the leader of web 10 (i.e., from the immediately following uniting bands still forming part of the running web) along the transversely extending lines 13. The thus separated foremost uniting band 8 (i.e., the uppermost band shown in FIG. 1) is thereupon convoluted around a group of three coaxial rod-shaped articles including a centrally located filter rod section (mouthpiece) 6 of double unit length and two plain cigarettes 7 of unit length. The thus obtained filter cigarette of double unit length is thereupon severed at 14 midway across the mouthpiece 6 and hence midway across the tubular envelope (converted uniting band 8) to yield two filter cigarettes of unit length. The same procedure is thereupon repeated with the next-following (lower) uniting band 8 of the web 10, and so forth. The just described steps of making successive pairs of filter cigarettes of unit length are fully described in and fully illustrated in FIG. 2 of the aforementioned U.S. Pat. No. 5,135,008 to Oeasterling et al.

Each row of perforations 11 forms an annulus of holes around the circumference of the respective filter mouthpiece of unit length when the conversion of a uniting band 8 into the tubular wrapper of the filter mouthpiece 6 and the adjacent end portions of two plain cigarettes 7 of unit length is completed. The purpose of the perforations 11 is to permit entry of streamlets of cool atmospheric air into the filter mouthpiece (i.e., into one-half of a filter rod section 6) when the smoker lights the exposed end of the tobacco-containing portion of the filter cigarette; this is believed to reduce the effect of nicotine and tar entering the mouth of the smoker by reducing the percentage of such substances in tobacco smoke. In FIG. 1, the perforations 11 are shown drawn to a greatly enlarged scale for the sake of clarity.

The characters 12 denote those areas of one side of each uniting band 8 which are to be coated with a suitable adhesive substance. Such areas do not include those which are provided with the perforations 11 and those which are to be severed (at 14) to divide each convoluted web section 8 into two tubular wrappers simultaneously with subdivision of the respective filter mouthpiece 6 of double unit length into two filters of unit length. Absence of adhesive in the regions of perforations 11 is highly desirable because the adhesive could prevent or unpredictably and undesirably reduce the inflow of atmospheric air into the tubular filler of the filter mouthpiece forming part of the lighted filter cigarette.

Absence of adhesive at the free end (at 14) of the filter mouthpiece of a finished filter cigarette of unit length at the very free end (at 14) of the filter mouthpiece of a finished filter cigarette of unit length is just as desirable, for example, because the adhesive is less likely to come into contact with the lips of the smoker. In addition, the absence of adhesive at 14 ensures or increases the likelihood that the implement (the so-called cutoff) which is used to subdivide filter cigarettes of double unit length into filter cigarettes of unit length is less likely to be contaminated with adhesive. The same holds true for the regions 13 where the leader of the running web 10 is severed to yield discrete uniting bands 8, i.e., the tool which is employed to carry out such severing work is less likely to be contaminated by adhesive.

Certain relevant component parts of an adhesive metering and applying apparatus which embodies one form of the present invention are shown schematically in the lower part of FIG. 1. The apparatus comprises a holder or carrier 20 forming part of an applicator further including an array of five nozzles including a larger centrally located (twin) nozzle 121 and two pairs of identical or similar smaller nozzles 21. The two pairs of nozzles 21 flank the nozzle 121. Each nozzle 21 has an adhesive-discharging slit-shaped orifice 24 and an inlet 22 which receives adhesive from the discharge end of a conduit 23 (this conduit forms part of the means for connecting a single source 294 of adhesive with the applicator including the carrier 20, the nozzles 21 and the nozzle 121) and delivers adhesive to the orifice 24 by way of a recess or chamber 25. The inlet 22 can constitute the discharge end of the respective conduit 23 of the connecting means.

The means for regulating the rate of flow (including terminating (interrupting) and restarting the flow) of adhesive from the single source 294 shown in FIG. 1 (or from several sources 291, 292, 293 shown in FIG. 5) includes adjustable valves 26 in the connecting means including the conduits 23 and additional conduits 27*a*, 27*b*, 27*c*. The purpose of the chambers 25 is to regulate the rate of application of adhesive onto the respective portions of one side of the web 10 of tipping paper. In addition, or primarily, the chambers 25 serve to ensure that an adequate supply of adhesive is closely adjacent the loci of application of adhesive to the respective portions (strips) of one side of the web 10.

The larger median nozzle 121 serves to supply adhesive to two median strips 5 at the one side of the web 10; such strips flank the narrow uncoated portion 14 where the finished filter cigarette of double unit length is ultimately split into two filter cigarettes of unit length.

FIG. 1 shows that the valves 26 for the two outermost nozzles 21 receive adhesive at a first pressure P1, that the valves 26 for the nozzles 21 which immediately flank the centrally located nozzle 121 receive adhesive at a different second pressure P2, and that the valve 26 for the two sections or halves of the central or median nozzle 121 receives adhesive at a different third pressure P3. The adhesive which is supplied at the pressure P1 is drawn from the single source 294 by a first adjustable pump 281; a second adjustable pump 282 supplies adhesive from the source 294 to the nozzles 21 immediately flanking the nozzle 121 at the pressure P2; and a third adjustable pump 283 feeds adhesive, at the pressure P3, from the source 294 to the valve 26 for the median nozzle 121.

The adjustments of the pumps 281 to 283 can be such that the pressure P1 equals the pressure P2 and that the pressure P3 exceeds or is less than the pressure P1.

Since the two outermost nozzles 21 deliver adhesive to those (outermost) marginal portions 12 of one side of the running web 10 which are to adhere to the adjacent end portions of the wrappers of the two plain cigarettes 7 upon subdivision of the web into a series of discrete uniting bands 8, such marginal portions 12 should normally receive relatively large quantities of adhesive. In other words, the marginal portions 12 of the web 10 should receive thicker or relatively thick layers or films of adhesive.

Furthermore, and since it is advisable to ensure a highly reliable delivery of preselected optimum quantities of adhesive to the web portions 12 which receive adhesive from the two outermost nozzles 21, these two nozzles receive adhesive at an optimum pressure P1 from the discrete pump 281 by way of conduits 27*a* leading to the respective outermost valves 26. Such possibility of supplying adhesive to the two outermost valves 26 independently of the other valves is desirable and advantageous on the additional grounds that (a) this enables the improved apparatus to compensate for eventual departures of the finish of the outermost nozzles 21 from an optimum finish (i.e., to compensate for manufacturing tolerances of the outermost nozzles 21), (b) this renders it possible to compensate for departures of the speed and/or guidance of the web 10 from optimum values, and/or (c) this renders it possible to compensate for eventual departures of absorbency of the web 10 or of certain strip-shaped portions of the web from a desirable optimum absorbency. In fact, it is also within the purview of the present invention to use discrete pumps (281) or other suitable sources of properly pressurized adhesive for each of the two outermost nozzles 21.

The valves 26 at the inlets of those conduits 23 which supply adhesive from the pump 282 at the pressure P2 are designed to supply adhesive intermittently, namely to those portions (shown at 52 in FIG. 5) of one side of the web 10 which alternate with the two rows of perforations 11. Such intermittent application of adhesive via the two inner nozzles 21 is possible or can be carried out in a more reliable manner if the pressure P2 of adhesive being supplied by the pump 282 is low, relatively low or very low. The pump 282 and the associated valves 26 cooperate to ensure that the pressure P2 can be selected, varied and/or maintained in an optimum manner to ensure a highly predictable intermittent feeding of adhesive to the adjacent sections or strips of one side of the running web 10 by way of the nozzles 21 which are immediately adjacent the median nozzle 121.

Those parts of the connecting means which include the conduits 27*a* and the respective conduits 23 cooperate with the pump 281 to supply adhesive to the two outermost nozzles 21 at the pressure P1 which is best suited for application of adhesive to the areas 12 at one side of the running web 10. The means for connecting the source 294 with the inner nozzles 21 includes two composite conduits each including a conduit 27*b* and the respective conduit 23. The median nozzle 121 receives adhesive (at the pressure P3) from the source 294 by way of that part of the connecting means which includes the conduit 27*c* and the corresponding conduit 23.

Figure 2:
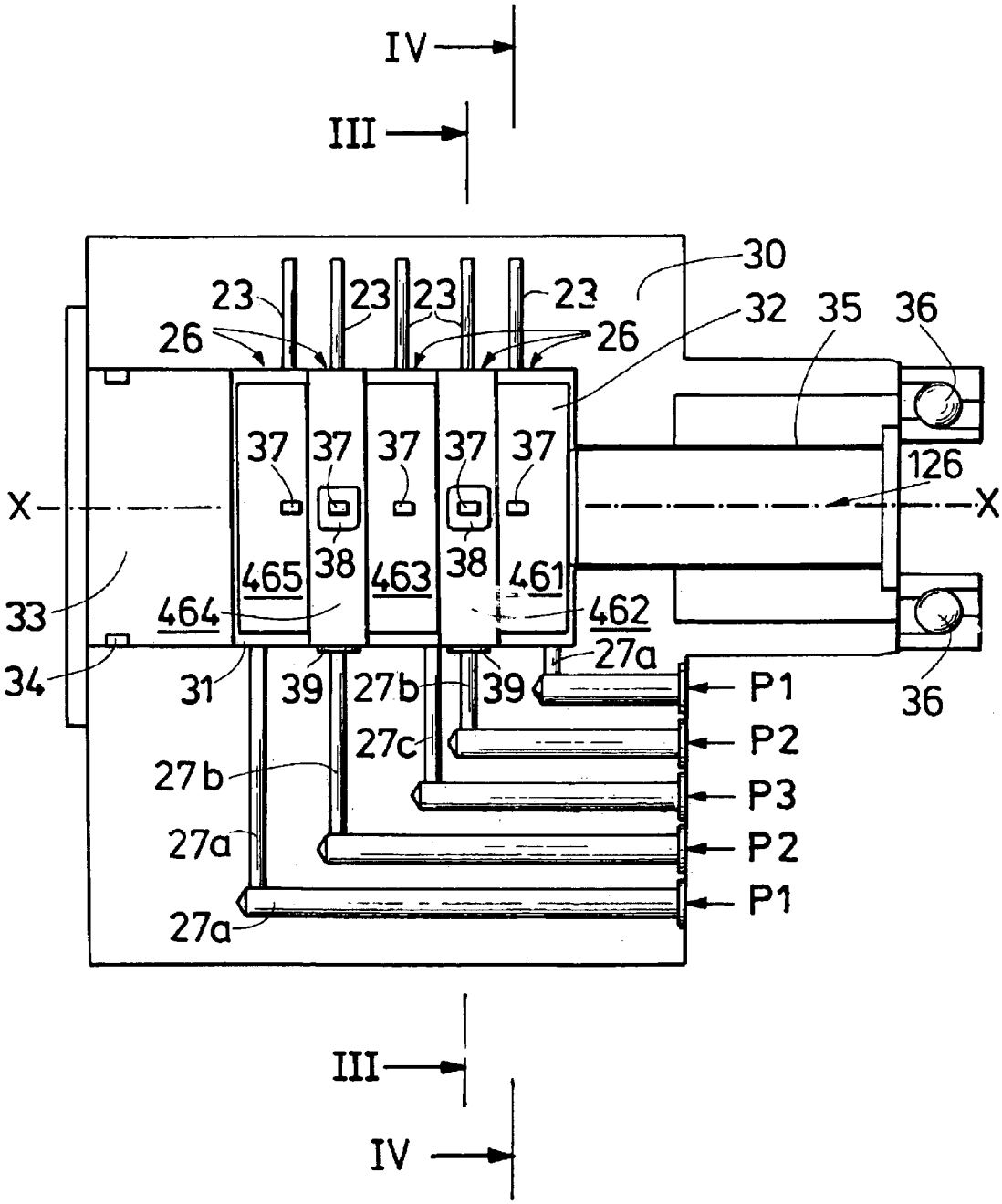
FIG. 2 is an enlarged partly schematic sectional view of certain details of the apparatus shown in the lower part of FIG. 1.

FIG. 2 shows one presently preferred form of that part (namely the regulating means) of the improved apparatus which includes the valves 26. The five valves 26 have a common roller-shaped rotary valving element 32 which can be caused to turn by a suitable motor 126 in the cylindrical chamber of a stationary valve housing or valve body 30 (hereinafter called stator for short). The common axis of the stator 30 and valving element (rotor) 32 is shown at X—X. The clearances or gaps between the exterior of the rotor 32 and the internal surface of the stator 30 are filled with flowable adhesive. A cover 33 constitutes or forms part of a means for sealing the interior of the stator 30 (at one axial end of the rotor 32) from the surrounding atmosphere. Such sealing means further comprises a resilient sealing ring 34 which is confined between the stator 30 and the cover 33.

The composite valving system including the valves 27 further comprises a friction bearing 35 which ensures that the rotor 32 can be driven with a minimum of effort. In order to balance the forces or stresses which develop when the rotor 32 is caused to turn, the valving system of FIG. 2 further comprises an antifriction ball bearing 36.

Each of the five disc-shaped sections 461 to 465 of the rotor 32 forms part of one of the five valves 26, and the corresponding annular sections of the stator 30 receive adhesive from the respective pumps 281–283 (not shown in FIG. 2) by way of the corresponding conduits 27*a* –27*c*.

FIG. 2 shows the rotor 32 in that angular position in which three of the five valves 26 can admit adhesive from the respective sources into the corresponding nozzles, namely to the conduits 23 leading to the two outermost nozzles 21 and to the conduit 23 leading to the central nozzle 121. Thus, the apparatus embodying the structure of FIG. 2 is set up to supply films of adhesive to the two marginal portions 12 at one side of the running web 10 and to the median portions 5 of such one side (namely to the two stretches flanking the narrow uncoated strip 14 and being flanked by the two rows of perforations 11.

It is clear that the rotor 32 adequately seals the five annular sections of the chamber in the stator 30 from each other so that each of the five conduits 23 can receive adhesive only from the respective conduit 27*a*, 27*b* or 27*c*.

The five sections 461–465 of the rotor 32 may but need not be made of one piece from a suitable metallic, plastic or other material. The sections 461, 465 form part of the two outermost valves 26, the section 463 forms part of the median valve 26, and the sections 462, 464 form part of the remaining two valves in the group of valves 26 shown in FIGS. 1 and 2. The peripheral surfaces of the rotor sections 461–465 are provided with male and/or female irregularities such as projections or lobes 37 which can be orbited about the axis X—X to positions of overlap or registry with the inlets of the respective conduits 23 (i.e., with the outlets of the respective valves 26) so that such conduits are then sealed from the respective pumps 281–283 and conduits 27*a* –27*c*. The female irregularities include recesses or depressions (such as grooves) 38, each of which surrounds one of the projections 37.

The heights of the projections 37 which are surrounded by recesses 38 are selected in such a way that their outermost portions (top lands) do not extend radially outwardly beyond the surfaces of the respective rotor sections 262, 264. Therefore, the conduits 23 leading to the two inner nozzles 21 of FIG. 1 can receive only such adhesive which enters internal grooves 39 of the adjacent portions of the stator 30. Each groove 39 can constitute a nearly circumferentially complete internal groove. One such groove 39 is shown in greater detail in FIG. 3; this groove defines an arcuate path extending along an arc of very close to but still less than 360°.

The sections 461, 463, 465 of the rotor 32 permit adhesive to flow from the respective conduits 27*a*, 27*c*, 27*a* into the associated conduits 23 during the entire revolution of the rotor 32 relative to the housing 30 except during the intervals of movement of their projections 37 along the inlets of the respective conduits 23. The sections 462, 464 of the rotor 32 cooperate with the stator 30 to permit entry of adhesive into the respective conduits 23 (i.e., onto the running web 10) at a rate and to the extent necessary to apply adhesive to the web portions (at 52 in FIG. 5) between the respective rows of perforations 11. To summarize, the valves 26 are designed and installed to enable the nozzles 21, 121 to coat one side of the running web 10 save for the locations provided with the perforations 11 and the strips along the lines 13 and/or 14 shown in FIG. 1.

Figure 3:
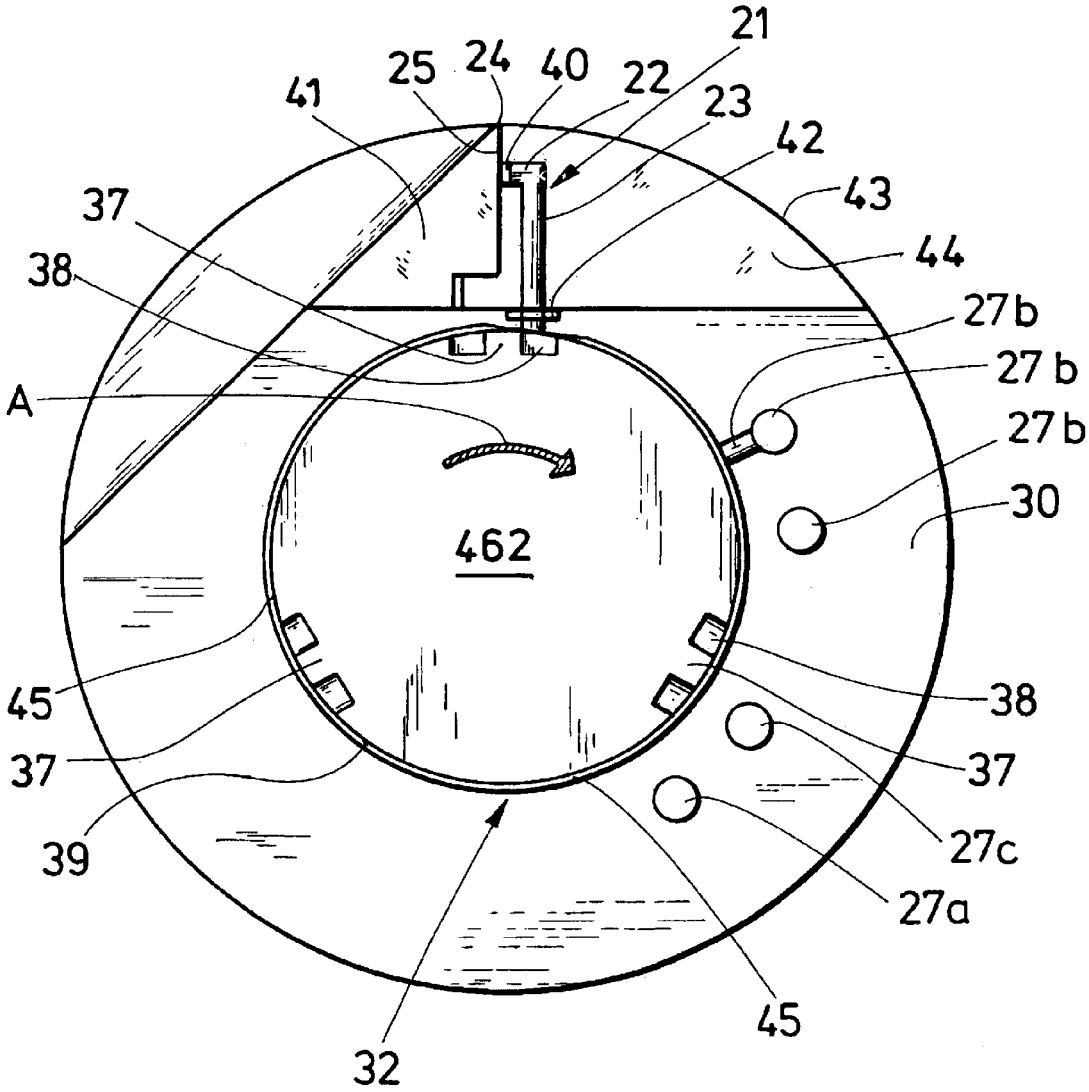
FIG. 3 is a schematic sectional view substantially as seen in the direction of arrows from the line III—III in FIG. 2 and shows one embodiment of a composite valve.

FIG. 3 is a schematic sectional view as seen in the direction of arrows from the line III—III in FIG. 2. That one of the two identical internal grooves 39 which is illustrated in FIG. 3 extends along an arc of 360° minus the region where it communicates with the inlet of the respective conduit 23 leading to one of the two inner nozzles 21. The rotor 32 turns in a clockwise direction as indicated by the arrow A. The section 462 of the the rotor 32 comprises three equidistant projections 37 each of which is surrounded by a recess 38 or by two discrete parts of a composite recess. The conduits 27*a* to 27*c* which are shown in FIG. 3 can constitute, at least in part, bores or channels provided in the stator 30 and extending from the outlets of the respective pumps 281–283 to the chamber 31 of the stator 30. The thus admitted adhesive gathers in the grooves 39 surrounding the rotor sections 462, 464 and in those annular portions of the chamber 31 which surround the rotor sections 461, 463 and 465.

When the rotor 32 assumes the angular position which is shown in FIG. 3, it permits adhesive to flow around the rotor sections 461, 463, 465 and thence into the conduits 23 leading to the median nozzle 121 and to the two outermost nozzles 21.

Figure 4:
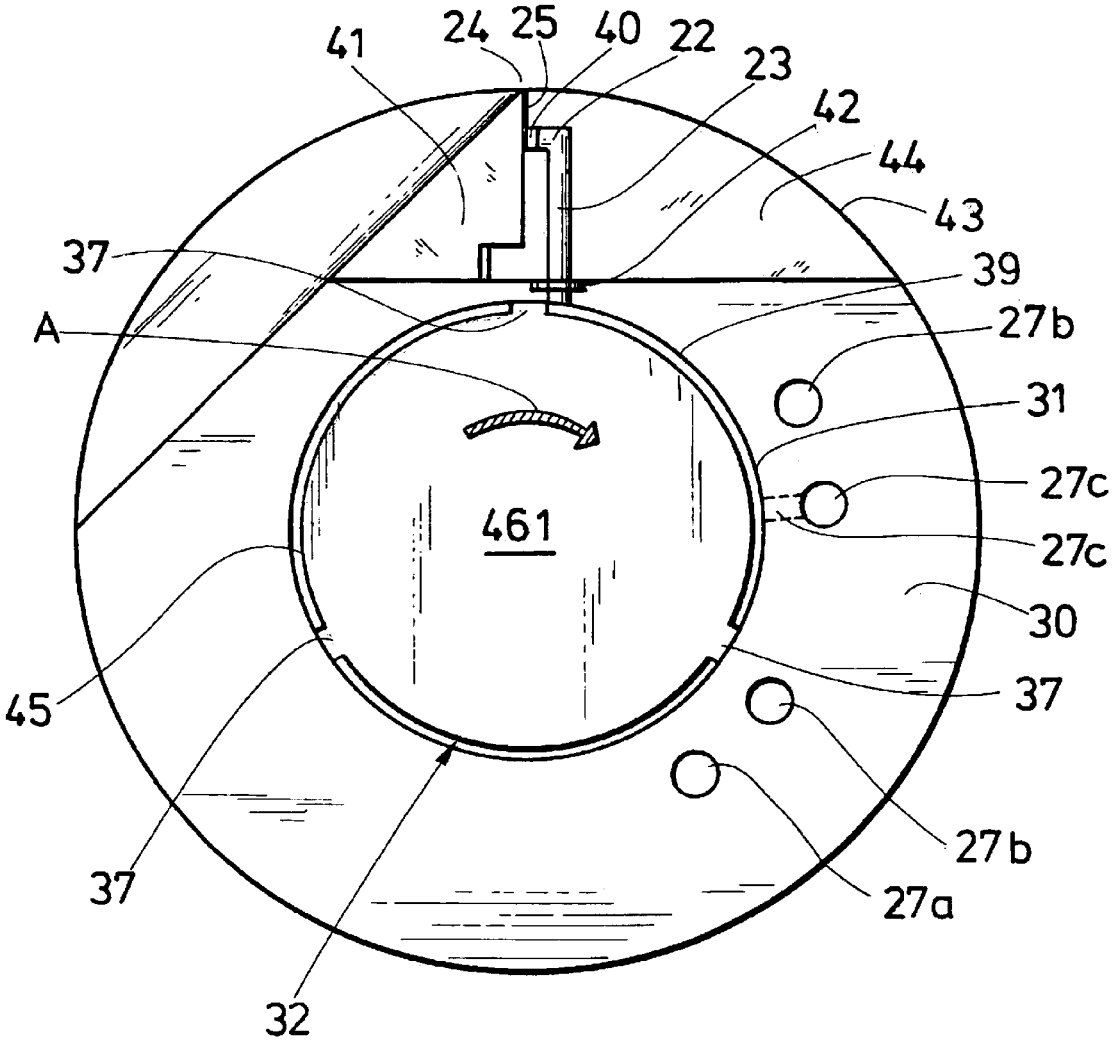
FIG. 4 is a similar schematic sectional view substantially as seen in the direction of arrows from the line IV—IV in FIG. 2.

An annular sealing element 42 (e.g., an O-ring) which is shown in FIG. 4 is provided to seal the eventual gap between the rotor 32 and a common head 44 accommodating and/or embodying the nozzles 21 and 121. The adhesive flowing in the internal groove 39 of the stator 30 shown in FIG. 3 gathers in the recesses 38 and flows from the recess 38 located at the 12 o'clock position of the rotor 32 into the conduit 23 leading to the respective outer nozzle 21. The inlet 22 shown at the top of FIG. 3 admits adhesive into a cavity 40 which serves to determine the quantity of adhesive entering the inlet 22 of the respective nozzle 21. The inlet 22 admits the predetermined quantity of adhesive into the respective orifice 24 by way of the corresponding chamber 25 in the nozzle carrier 20. The chamber 25 can also serve (or can serve in lieu of the cavity 40) as a means for metering the quantity of adhesive which is to be discharged via the corresponding orrifice 24.

A plate-like cover or lid 41 is provided to lie at least substantially flush against the head 44. The peripheral surface 43 of the head 44 serves to guide successive increments of the running web 10 into the range of the orifices of the nozzles 21 and 121. A pronounced or sharp tear-off edge is or can be provided immediately downstream of the nozzles 21, 121 (as seen in the direction of the arrow 9 shown in FIG. 1, i.e., in the direction of advancement of the web), to separate successive uniting bands 8 from the leader of the running web.

The chambers 25 in the nozzle head 44 can be utilized to determine the quantity of adhesive being actually applied to successive increments of the corresponding strip-shaped portions of one (adhesive-receiving and bearing) side of the running web 10. For example, the quantities of applied adhesive can be varied by utilizing a set of heads 44 each having cavities and/or chambers 25 of different sizes. The chambers 25 can serve to ensure that adequate quantities of adhesive can be stored to thus guarantee satisfactory distribution of adhesive along the full length of the carrier 20, i.e., by way of all of the nozzles 21 and 121.

FIG. 4 is a transverse sectional view of another portion of the carrier 20, namely across the section 461 of the rotor 32. The peripheral surface 45 of the rotor section 461 is provided with three projections 37 which serve to interrupt the admission of adhesive to the conduit 23 leading to the right-hand outermost nozzle 21 of FIG. 1.

Figure 5:
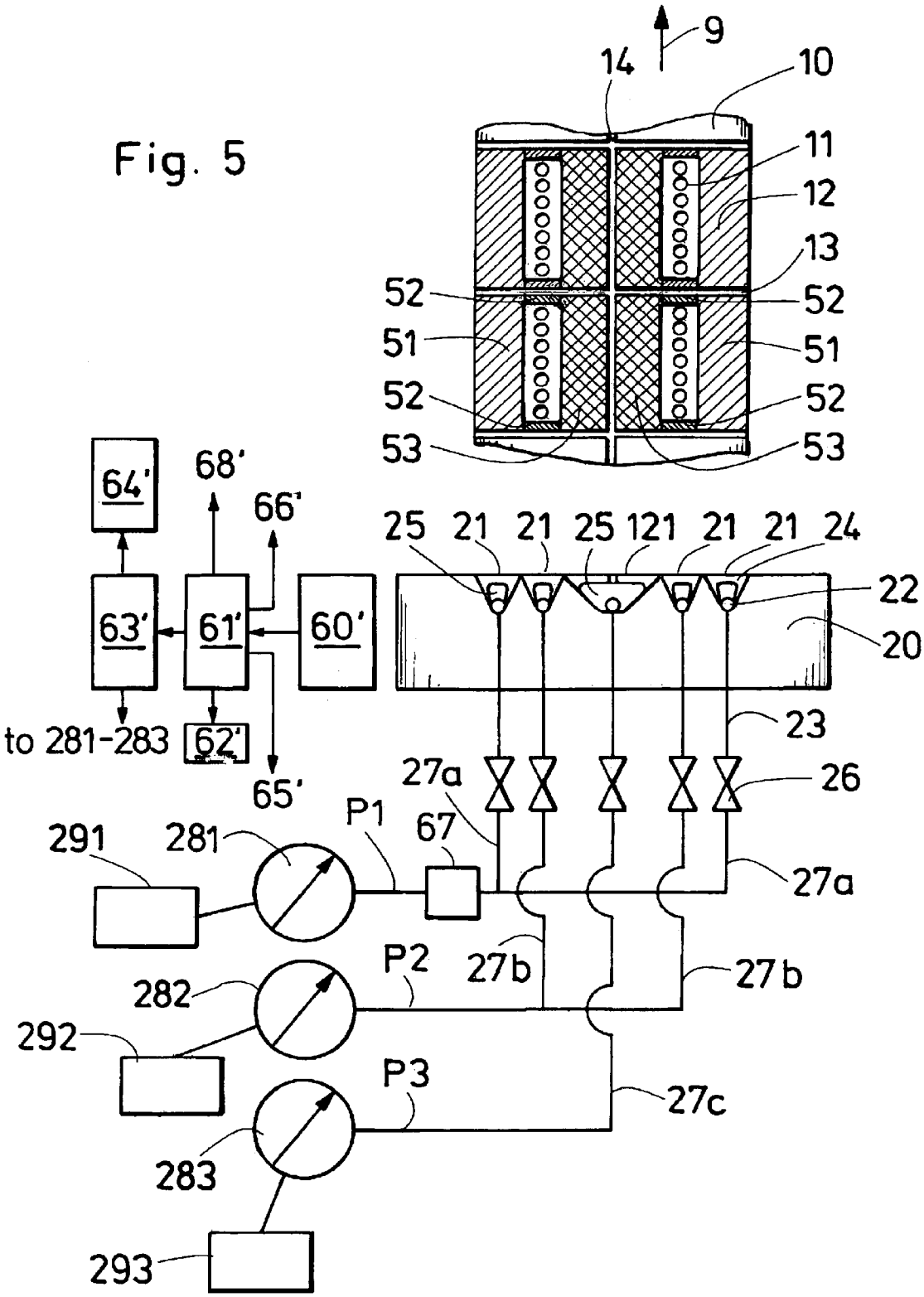
FIG. 5 is a view similar to that of FIG. 1 but showing certain details of a modified apparatus.

FIG. 5 illustrates a portion of a running web 10 of tipping paper and certain constituents of a modified adhesive applying apparatus which can be utilized to apply a predetermined pattern of adhesive films to one side of the web.

The hatched areas 51 denote those portions of one side of the web 10 which are coated with a first type (type 1) of adhesive. These are the parts which adhere to and are convoluted around he inner end portions of plain cigarettes 7 (see FIG. 1) after the respective portion of the leader of the web 10 is converted into a uniting band which connects two coaxial plain cigarettes 7 with a filter mouthpiece 6 of double unit length.

A second type (type 2) of adhesive is applied to the sections 52 of the web 2 shown in the upper portion of FIG. 5 by the nozzles 21 which are immediately adjacent the median nozzle 121. The sections 53 of that side of the web 10 which faces the observer of FIG. 5 are coated (by the nozzle 121) with films of a third type (type 3) of adhesive; these films serve to bond the median portions of successive uniting bands 8 to the peripheral surfaces of filter mouthpieces 6 of double unit length.

Adhesive of the first type is drawn from a first source 291 by the pump 281 and is supplied (at the pressure P1) to the valves 26 serving to regulate the admission of adhesive to the two outermost nozzles 21 of the apparatus shown in FIG. 5. The pump 282 draws adhesive of the second type from a sorce 292 and delivers such adhesive (at the pressure P2) to the valves 26 serving to regulate the flow of adhesive to the two inner nozzles 21. Adhesive of the third type is drawn, by the pump 283, from a third source 293 and is supplied (at the pressure P3) to the valve 26 which supplies adhesive to the median nozzle 121.

The adhesive which is supplied by the source 291 can constitute a fire extinguishing and/or fire retarding and/or fire preventing substance. It will be recalled that such adhesive is supplied to the sections 51 of the running web 10, i.e., to those portions of filter mouthpieces of filter cigarettes which are nearest to the lighted ends of such smokers' products.

The adhesive which is supplied by the source 292 (and is applied to the portions 52 of the illustrated surface of the running web 10 shown in FIG. 5) can constitute a standard adhesive (e.g., a hotmelt), and the adhesive furnished by the source 293 and supplied to the portions 53 of the web 10 can contain one or more flavoring agents, i.e., aromatic substances which are likely to be pleasant to the smoker and which are effective because they are applied to the mouthpieces of the finished filter cigarettes, i.e., to parts which enter the mouths of smokers of filter cigarettes.

The three sources 291–293 can be replaced with a single source (such as the source 294 shown in FIG. 1). In order to impart to the apparatus of FIG. 1 a versatility matching or approaching that of the apparatus shown in FIG. 5, the apparatus of FIG. 1 is or can be provided with one or more injectors. FIG. 1 shows a first injector 61 which supplies a combustion preventing or opposing agent (i.e., a substance corresponding to that contained in the adhesive confined in the source 291 shown in FIG. 5). A second injector 62 can supply one or more desirable ingredients into the adhesive flowing in the conduits 27*b* serving to convey adhesive to the inner nozzles 21, and a third injector 63 can be utilized to admit metered quantities of one or more flavoring agents into the conduit 27*c* servicing the valve 26 for the nozzle 121.

Numerous other modifications of the improved methods and apparatus can involve various undertakings which contribute to compactness, versatility, lower cost and/or to other desirable characteristics of the ultimate products. For example, the improved apparatus can be modified for use in tipping machines of the character designed to produce filter cigarettes of unit length, i.e., to provide uniting bands large enough to combine plain cigarettes of unit length with filter mouthpieces of unit length.

Referring again to FIGS. 1 to 4, when one of the projections 37 and the concave surface 45 shown in FIG. 3 advance past the inlet of the conduit 23 leading to the nozzle 21 shown in FIG. 1 beneath the right-hand rows of perforations 11, this conduit communicates with the pump 282 and the source 294 by way of the recess 38 at the 12 o'clock position of the disc 262. On the other hand, when the disc 461 of the rotor 32 reaches the angular position of FIG. 4, the rightmost nozzle 21 is free to communicate with the respective conduit 27*a* by way of the right-hand groove 39 shown in FIG. 2, i.e., by way of the groove 39 shown in FIG. 4.

One of numerous important advantages of the two improved apparatus shown in FIGS. 1–4 and 5 is that they permit for highly accurate feeding of adhesive (from the single source 294 shown in FIG. 1 or from the selected source or sources 291–293 shown in FIG. 5) into the nozzles provided in the respective carrier 20. Moreover, the interruption of delivery of adhesive to one or more nozzles is not followed by the delivery of excessive quantities of adhesive upon renewed opening of the respective valve(s) 26.

Another important advantage of the improved apparatus is that the rate of flow of adhesive into and from the nozzles 21, 121 is uniform (i.e., steady) regardless of whether the flow of adhesive is restarted or is about to be interrupted. All this contributes to considerable savings in adhesive and to higher quality of the ultimate smokers' products because each selected section of one side of the web 10 is coated with an optimum quantity of adhesive which is supplied at the optimum pressure and from the appropriate source (provided that the improved apparatus employs two or more sources of adhesive—see the sources 291–293 shown in FIG. 5).

The making of perforations 11 in the web 10 can be carried out prior to storing of the web in the form of a roll. Alternatively, the making of perforations 11 can take place while the web 10 is being advanced toward the carrier 20 for the nozzles 21 and 121. The manner of making perforations in a running web of cigarette paper, tipping paper and the like is disclosed in numerous US patents many of which are owned by the assignee of the present application. Reference may be had, for example, to U.S. Pat. No. 5,060,668 granted Oct. 29, 1991 to Weinhold for "DEVICE FOR THE PRODUCTION OF AT LEAST TWO ADJACENT ROWS OF PERFORATIONS IN CIGARETTES AND/OR FILTER LINING PAPER OR FILTER WRAPPING PAPER". Commonly owned U.S. Pat. No. 4,889,140 (granted Dec. 26, 1989 to Lorenzen et al. for "APPARATUS FOR MAKING PERFORATIONS IN ARTICLES OF THE TOBACCO PROCESSING INDUSTRY" discloses another apparatus which can provide a running web of wrapping material for rod-shaped smokers' products with several (e.g., four) rows of perforations. U.S. Pat. No. 4,121,595 (granted Oct. 24, 1978 to Heitmann et al. for "APPARATUS FOR INCREASING THE PERMEABILITY OF WRAPPING MATERIAL FOR ROD-SHAPED SMOKERS' PRODUCTS") discloses an apparatus which can perforate a running web of cigarette paper or the like, or the tubular wrappers of rod-shaped smokers' products. At least some of the above-enumerated patents disclose apparatus which can provide the web 10 of FIG. 1 or 5 with perforations 11 and/or with other suitable (e.g., other than round) perforations. As already explained hereinbefore, perforations which are provided in tubular envelopes of rod-shaped smokers' products are considered to be desirable and advantageous because they admit cool atmospheric air into the column of tobacco smoke flowing from the lighted end of a smokers' product into the smoker's mouth; this is believed to entail a reduction of the percentage of tar and nicotine in the tobacco smoke which actually reaches the smoker's mouth because such (cooled and less concentrated) substances are more likely to be intercepted by the filamentary or other filler of the filter mouthpiece.

Certain presently preferred methods of and apparatus for draping uniting bands around successive groups of coaxial plain cigarettes and filter mouthpieces are disclosed, for example, in commonly owned U.S. Pat. No. 4,825,882 granted May 2, 1989 to Hinz for "APPARATUS FOR ROLLING UNITING BANDS ABOUT GROUPS OF ROD-SHAPED ARTICLES". Such or analogous apparatus can be utilized to convolute successive adhesive-coated uniting bands 8 around groups of coaxial rod-shaped articles (such as the articles 7, 6, 7 shown in FIG. 1) upon separation of successive adhesive-coated bands from the leader of the web 10.

The valves 26 of the type shown in FIGS. 1–4 (the valves in the apparatus of FIG. 5 are or can be identical with those shown in FIGS. 1–4) together constitute a novel composite valve which has been found to be highly satisfactory for use in a filter cigarette maker or an analogous machine, and more specifically in that part or aggregate or module of a filter cigarette maker or the like which is to regulate the flow of a given type of adhesive or of two or more different types of adhesive to one side or surface of a running web of wrapping material or any other material which web need not or should not have one of its sides fully coated with one or more adhesives and/or which is to be provided with a relatively simple and/or a complex or highly complex pattern of adhesive films.

The illustrated and/or analogous recesses (such as 38) and/or projections (37) exhibit the advantage that they can be provided in the rotor 32 in a time-saving manner as well as by resorting to relatively simple and readily available tools, groups of tools or machines. Such and/or analogous recesses and projections can be formed in, at and/or on the peripheral surfaces of discrete discs (461–465) which are thereupon assembled into a one-piece rotor (32), or in a one-piece rotor wherein the discs are neighboring parts of a converted one-piece block of a suitable material. An additional advantage of the projections 37 (or analogous projections) and/or of the recesses 38 (and/or analogous recesses) is that they can be readily formed and finished with a requisite degree of precision by resorting to available machinery.

An additional important advantage of the improved composite valve including the rotor 32 and the valve housing or stator 30 therefor is that such flow regulating means occupies a relatively small amount of space which is always at a premium in a modern filter cigarette maker. Moreover, the parts 37, 38 can be readily provided with a degree of finish which ensures that the wear upon such parts is negligible or minimal, even after long periods of extensive use, especially since at least some types of adhesive can serve as a substance which lubricates the external surface of the rotor 32 and/or the internal surface of the stator 30.

The just discussed composite valve (i.e., the adhesive flow regulating means of the improved apparatus) is surprisingly simple in spite of its versatility and ability to provide the web 10 with a relatively simple as well as a complex or highly complex pattern of adhesive films. Thus, all that is actually necessary is to provide the peripheral surface of the rotor 32 with a more or less complex pattern of projections (37) and/or recesses (38) and to ensure that such unevennesses or irregularities are properly distributed at the periphery of the rotor. Identical, similar, slightly different and/or pronouncedly different patterns of unevennesses or irregularities 37, 38 and/or the like can be provided on neighboring and/or spaced-apart discs (461–465) of the rotor 32 shown in FIG. 5, depending upon the desired distribution of adhesive film patterns (12, 13, 14 and/or the like) on successive uniting bands 8 to be yielded by the properly coated web 10 downstream of the carrier 20.

At least one of the discs 461–465 shown in FIGS. 2 to 4 can serve at least one additional purpose, for example, that of a sealing element which prevents adhesives of different types (see the sources 291–293 shown in FIG. 5) from mixing with each other. In addition, such at least one disc (or at least one other disc) can prevent adhesive streams which are to be maintained at different pressures (such as P1, P2 and P3) at least during certain stages of their flow from the pressurizing means (281–283) to those portions of their respective paths wherein it is no longer necessary to maintain the contents of discrete adhesive streams at different pressures. The surface(s) of at least that disc or those discs of the rotor 32 and the adjacent portion(s) of the internal surface of the valve body or stator 30 are preferably smooth surfaces; this simplifies and enhances the sealing action and reduces the likelihood of extensive wear. The seals between neighboring discs (461–465) of the rotor 32 and the adjacent portions of the internal surface of the stator 30 can be established by providing the discs with circumferentially complete rings (not specifically shown due to the relatively small scale of FIG. 2) which are received in the stator 30 with minimal clearance or play. The provision of bearing means 35 and/or 36 also contributes to a reduction of leakage of adhesive between neighboring valves 26 of the composite valve including the rotor 32 and the stator 30.

The adhesive which is stored in the single source 294 or the adhesives stored in the sources 291–293 can be of the commercially available type, e.g., one or more so-called cold glues or one or more so-called hot melts. Special qualities can be imparted by resorting to one or more injectors (such as those shown at 61–63 in FIG. 1). It goes without saying that one or more such injectors can also be installed in the apparatus of FIG. 5 and/or that the stream of adhesive flowing in the conduit 27*a* and/or 27*b* and/or 27*c* can receive additives from two or more injectors. FIG. 1 shows, by way of example, an injector 63*a* which is set up to introduce at least one additive into the conduit 27*c* in addition to that additive or those additives which can be introduced by the injector 63.

It is also possible to employ one or more injectors (one shown at 64) in at least one conduit 23 in addition to or in lieu of one or more injectors 61–63 and 63*a* in the conduit 27*a* and/or 27*b* and/or 27*c*.

By way of example, the injector 61 of FIG. 1 can be utilized to admit requisite quantities of an aroma infuencing substance (flavoring agent), e.g., a substance which can be extracted or otherwise obtained from certain types of tobacco. Alternatively, or in addition to such aroma influencing substances which are derivable from tobacco, it is possible to resort to natural or synthetic aroma influencing ingredients (flavoring agents) such as vanilla, cocoa and/or others. These aroma influencing substances are or can be admitted to adhesive which is to cover the central sections 5 of the web 10, i.e., which is to be contained in that portion of a convoluted uniting band 8 that is to enter the mouth of the smoker, i.e., the end portion remotest from the plain cigarette 7.

At least one section of one side of each uniting band 8 can be coated (at least in part) with an adhesive containing a suitable combustion- or flame-retarding or preventing substance, such as diammonium hydrogen phosphate. Such substance can be admitted via injector 61 of FIG. 1 to be confined in the adhesive coating the sections 12 of the web 10 shown in FIG. 1. Other combustion- or flame-retarding substances which can be applied in addition to or in lieu of diammonium hydrogen phosphate include melamine and dipentaerythrite.

The composite valve including the stator 30 and the rotor 32 can be provided with means for reliably sealing the adhesive supplied by the nozzle 121 from adhesive supplied by the two outer nozzles 21 in order to ensure that the adhesive (from the source 291 shown in FIG. 5) containing a combustion or flame retardant is not mixed with adhesive from the source 293 if the adhesive from the source 293 contains an aroma-influencing ingredient.

The provision of one or more grooves 39 in the internal surface of the valve body or stator 30 (in a plane which is normal to the axis X—X of the rotor 32) constitutes a simple but reliable solution of the problem of properly sealing regions for reception of adhesives at different pressures (such as P1 and P3 or P1 and P2 or P2 and P3) from each other. In addition, the provision of such grooves constitutes a simple and inexpensive but reliable solution of the problem of establishing small, sharply defined (if necessary) and adequately separated patterns in close or immediate proximity to each other.

An advantage of the chambers 25 is that they render it possible to transfer metered quantities of adhesive from the respective nozzles 21, 121 onto the adjacent portions of the running web 10. A chamber 25 can be provided for each of the nozzles 21, 121 or for one or more selected nozzles. The nozzles 21, 121 are preferably slotted (see the slit-shaped orifices 24).

If the capacities and/or the depths of the chambers 25 are adapted to conform to the quantities of adhesive to be applied by the respective nozzles 21 or 121, it is possible to vary or alter the quantities of adhesive to be applied to selected portions of one side of the running web 10 in a simple but highly reliable manner. It is particularly desirable to provide means for adjusting or conforming to a predetermined width the width(s) of the chamber(s) 25 and/or orifice(s) 24 of one or more nozzles 21, 121. This also permits for rapid adjustment of each of the thus adjustable nozzles to ensure that an optimum distribution, configuration and/or dimensioning of the respective film(s) or layer(s) of adhesive can be arrived at with little loss in time, i.e., without much experimentation and with minimal losses in web material and/or adhesive.

In accordance with a presently preferred embodiment, the carrier 20 and its nozzles 21, 121 can be made of stainless steel and each of the orifices 24 can have a length of between 6 and 12 mm and a width of 0.15 mm. Reference may be had, for example, to the German patent application No. 44 37 764 of Krappweis (published Apr. 25, 1996) and to the corresponding U.S. Pat. No. 5,769,947 granted Jun. 23, 1998 for "APPLICATOR FOR ADHESIVE AND CORRESPONDING NOZZLE PLATE". This patent discloses an apparatus employing a so-called nozzle plate provided with rows of circular orifices receiving adhesive from so-called glue valves the details of which are not shown and/or described. The patentee states that the glue valves can be electrically controlled in accordance with a high switching frequency.

It is often advisable to furnish the apparatus of the present invention with a set of carriers 20 each of which comprises one or more nozzles different from the nozzle(s) of the other carrier(s). A relatively small number of spare carriers 20 normally suffices to greatly enhance the versatility of the improved apparatus.

The convex external surface 43 of the head 44 of the carrier 20 (downstream of the stator 30, as seen in the direction (arrow 9) of advancement of the web 10) renders it possible to ensure that the web 10 can advance steadily (i.e., uninterruptedly or steadily at an optimum speed) which contributes to desirable predictability of the shapes and thicknesses of various films of adhesive being applied by te nozzles 21 and 121. The web 10 advances at an acute angle toward the severing or separating station (not shown) where it is folded and severed along successive lines 13 at which successive (adhesive-coated) uniting bands are separated from the leader of the next-following portion of the running web. The curvature of the peripheral surface 43 is selected to conform to the desired distance between successive lines 13; this renders it possible to ensure a steady and highly predictable advancement of successive (still coherent) uniting bands 8 toward the uniting band separating station.

The pumps 281–283 are preferably adjustable. This is desirable on the ground that adjustments of the pressure P1, P2 and/or P3 enable the person(s) in charge or an automatic control system to accurately select and/or vary the quantity of adhesive being applied per unit length of the running web 10.

The pressure of adhesive in each of the conduits 27*a* –27*c* and/or in one or more selected conduits 23 can be varied by the pumps 281–283 and/or by varying the widths (cross-sectional areas) of the conduits 27*a*, 27*b* and/or 27*c*. Such and/or other suitable undertakings render it possible to accurately conform the quantity of flowing adhesive to the speed of forward movement of the web 10 in a filter cigarette making or other machine, i.e., to the momentary output of such machine.

In a conventional filter cigarette making machine, namely in a machine wherein the application of adhesive patterns to one side of a running web of wrapping or tipping paper is effected by the peripheral surfaces of adhesive-applying rollers, the quantity of adhesive being transferred to the running web decreases proportionally with the operating speed (output) of the machine. On the other hand, a presently preferred method of this invention (which is being practiced with an apparatus employing nozzles) provides for increases of the pressure of adhesive in synchronism with increasing output of machine. The characteristic curve of such mode of operation is individually ascertainable and selectable for each of the various adhesives (such as those supplied by the sources 291–293). If the pressure (P1, P2 or P3) of the adhesive is increased in accordance with a specific characteristic curve, one can achieve an unchanging rate of adhesive application within the entire operating (RPM) range of the machine which embodies the apparatus of the present invention.

The improved apparatus can embody or can cooperate with means for effecting an intermittent (interruptable) delivery of adhesive; this is desirable and advantageous because such mode of admission of adhesive facilitates or brings about an automatic cleaning of (expulsion of contaminants from) the nozzles, especially of the nozzles which (as already described hereinbefore with reference to the nozzles 21, 121) are nozzles provided with elongated slot-shaped orifices.

Contaminations of the nozzles are likely to take place because the conveyed adhesive often entrains contaminants and/or due to the development of nucleation at the locations of pronounced wettability (hydrophylia). This results in the development in the adhesive flow of often pronounced tracks which contain a reduced quantity of adhesive or are even devoid of any adhesive. Tracks of such character can be eliminated by the intermittent application of elevated pressure(s), e.g., elevated pressures which can be caused to arise, e.g., in response to short-lasting sporadic or repeated closing and opening of a valve or the like. For example, the irregularities 37, 38 and/or analogous irregularities of the discs 461–465 can act as valving elements which repeatedly seal and expose the inlets of the conduits 23 with attendant intensive cleaning or unclogging of the paths for the flow of adhesive from the pumps 281–283 to the valves 21, 121.

An important advantage of the feature that those portions of the one side of the web 10 which are adjacent the separation lines 13 between successive uniting bands 8 being obtained in response to repeated severing of the leader of the web 2 are uncoated is that the tool which is being employed to separate successive uniting bands from the remainder of the web is invariably highly unlikely to be contaminated by adhesive. This reduces the number of down times of the machine which utilizes or cooperates with or embodies the improved apparatus. The just discussed feature (i.e., absence of adhesive along the lines 13) is of added importance because the severing tool or tools is or are less likely to be or cannot be contaminated with adhesive during standstills of the apparatus, e.g., if the tool or tools is or are in contact with the web 10 while the web is idle. Intervals of idleness of the web 10 can alternate with intervals of advancement at regular intervals in certain types of tipping machines.

The web 10 is also likely to be brought to a standstill, e.g., during replacement of an expired reel of such web with a fresh reel. Thus, those filter cigarettes which contain portions of a web coming from an expiring reel and portions of a fresh reel (i.e., coming from a web which is being drawn off a fresh reel and is spliced to the trailing end of the preceding web) are expelled from the tipping machine. Such stoppages of the improved apparatus can take place in response to the generation of signals by one or more detectors serving to track the splice between the web coming from an expiring reel and the web coming from a fresh reel. Filter cigarettes embodying portions of spliced-together expiring and fresh webs of tipping paper are normally expelled from the tipping machine by pneumatic ejector means.

An advantage of the feature which is shown in FIGS. 1 and 5, namely that the output of a pump (such as 281 or 282) is connected with several nozzles (such as the two outer nozzles 21 by way of the conduits 27*a* and the respective conduits 23 and the two inner nozzles 21 by way of the conduits 27*b* and the respective conduits 23) is that this renders it possible to avoid the development of excessive pressure peaks during closing of the respective valves 26 and/or during interruption of delivery of adhesive (e.g., in response to stoppage of the pump 281 and/or 282 or in response to closing of a valve (not shown) between the source 291 or 292 and the respective pump 281 or 282. The just discussed feature renders it possible to divide the pressure peaks between pairs of valves 26, i.e., to reduce such pressure peaks in half.

In accordance with a further important feature of the present invention, at least certain portions of the nozzles 21 and/or 121 are provided with coats or films of a substance which prevents the adhesive from clinging to portions of surfaces or to entire surfaces of such valves. Such prevention of accumulations of caked-on adhesive upon the surfaces of the nozzles reduces the likelihood of undesirable changes in the thicknesses of adhesive films which are being applied to selected portions or sections (such as 51 and/or 53) of the running web 10. For example, the aforementioned adhesive repellent can be applied to the surfaces bounding the orifices 24 and/or the chambers 25 of the nozzles 21 and/or parts which are made of metallic sheet material or the like. Such application is particularly important for those surfaces which bound narrow slit-shaped orifices and like passages where a relatively minor change in the width of the path for the flow of adhesive can result in a highly pronounced change of the rate of adhesive flow, i.e., in the thicknesses of adhesive films being applied to the running web.

The effectiveness of repellent which has been applied to surfaces bounding the orifices and/or other narrow or relatively narrow passages in the nozzles 21 and/or 121 can be monitored by resorting to one or more suitable detectors which monitors or monitor the thicknesses of the still wet adhesive films on the running web 10 and/or the thicknesses of dried adhesive films on or in the corresponding portions of tubular wrappers of finished filter cigarettes or the like. The detector or detectors can constitute optical or capacitive sensor(s). Acceptable capacitive sensors are disclosed, for example, in German patent No. 39 09 990; such sensors are designed to furnish signals denoting the sufficiency or lack of sufficiency of adhesive which is being applied to sheets of paper or the like. Signals which are being generated by the patented capacitive sensor are transmitted to an evaluating circuit which, in turn, transmits signals that are utilized to arrest the machine if the thickness of the monitored adhesive film is insufficient or excessive. A capacitive sensor of the type disclosed in the aforementioned German patent is installed adjacent the uncoated side of a running paper strip to ascertain the quantity of moisture in the applied adhesive layer and to thus indirectly indicate the thickness of such layer.

Another suitable system which is capable of ascertaining the adequacy and lack of adequacy (i.e., excessiveness and/or insufficiency) of an adhesive film or layer is disclosed in European patent 0 300 734 A2. This publication discloses an optical sensor which ascertains the intensity of radiation being reflected by the adhesive film on a running substrate of paper or the like. The intensity and/or other characteristics of a beam of radiation which is reflected by a web of paper or an analogous substrate is different from that which is reflected by a film of adhesive; furthermore, the intensity of radiation being deflected by a film of adhesive varies in dependency upon the thickness of the adhesive film.

It is within the purview of the present invention to equip or associate the improved apparatus with an optical and/or capacitive and/or other suitable sensor 60' (see FIG. 5) which constitutes a monitoring means and transmits signals to an evaluating unit 61' (e.g., an electronic circuit); the latter transmits (when necessary) signals to a prime mover 62' of a filter cigarette making machine, and such prime mover is brought to a halt if the thickness of applied adhesive layer(s) is excessive or insufficient. Alternatively or in addition to such regulation of the prime mover 62', the evaluating circuit 61' can transmit signals to an adjustable arrangement 63' which regulates the operation of the pumps 281–283 and/or of a variable-speed motor 64' serving to advance the web 10 (in the direction of arrow 9) at a selected one of a finite or infinite number of different speeds.

The sensor 60' can constitute a laser-operated distance sensor which is or which can be installed adjacent the nozzles 21, 121. This sensor can distinguish between the thickness of an uncoated portion of the web 10 and the thickness of a web portion which carries a film of adhesive. Alternatively, the sensor 60' can monitor the distance of the web 10 from a reference point; such distance increases or decreases when the pumps 281–283 are started and at least one of the valves 26 is open, i.e., when the adhesive issuing from one or more nozzles 21, 121 begins to impinge upon the running web. Furthermore, the aforementioned distance changes also when the quantity of adhesive issuing from the nozzle(s) 21 and/or 121 changes, i.e., the sensor 60' can indirectly monitor the thickness(es) of the adhesive film(s) being applied to the running web by one or more nozzles of the array of nozzles 21, 121 shown in FIG. 5.

The controls including the parts 60' to 64' shown in FIG. 5 are designed to adjust (at 63') the pressure of adhesive being applied by the pumps 281–283 and/or (at 64') the speed of lengthwise movement of the web 10 in the direction indicated by the arrow 9. It is also possible to employ adjustable nozzles 21 and/or 121 and to monitor the thicknesses of adhesive films or layers on the web 10 for the purpose of adjusting such valve(s) when the monitored thickness of the adhesive film(s) departs from a range of acceptable thicknesses. The corresponding output of the evaluating circuit 61' is shown at 65'. Still further, the evaluating circuit 61' can have an output (66') which transmits signals to adjustable flow restrictor means (one shown schematically at 67') which can regulate the effective cross-sectional area(s) of conduit(s) 27*a*, 27*b*, 27*c* and/or 23 and hence the rate of flow of adhesive to te nozzle(s) 21, 121, i.e., the thickness(es) of adhesive film(s) being applied to the web 10.

The evaluating circuit 61' can also serve to regulate the rotational speed of the rotor 32 forming part of the composite valve further including the body or stator 30. The corresponding output of the circuit 61' is shown at 68'; the signals being transmitted by the output 68' control the RPM of the motor 126.

As already mentioned hereinbefore, the rotor 32 can be provided with one or more irregularities (such as 37 and/or 38) per disc (461–465). For example, if one of these discs is provided with a single irregularity, the RPM of the rotor 32 can be selected in such a way that the application of adhesive to one of the uniting bands 8 is completed in response to one complete revolution of the rotor. Thus, if the number of irregularities per disc exceeds one, the improved apparatus is set up to complete the application of adhesive to two or more successive uniting bands 8 during each revolution of the rotor 32.

The accuracy of the outlines of adhesive films being applied to one side of the web 10 is higher if the number of irregularities on the rotor 32 is lower. The interruption of application of adhesive (such as at 13 on the web 10 shown in FIG. 1) is simpler and more reliable if the distances between successively applied discrete adhesive films are greater. This can be achieved by prolonging he intervals of standstill of the rotor 32; however, such prolonging necessitates a rotation at high speed when the rotor is in motion. The selection of optimum circumstances for the operation of controls for the improved apparatus will be readily comprehended by those skilled in such field of endeavor upon perusal of the preceding passages of this disclosure.

It is often preferred to select the characteristics of the rotor 32 in such a way that at least one of its discs 461–465 carries four irregularities (such as 37 and/or 38). The motor 126 (FIG. 1) for the rotor 32 can be operated in synchronism with the variable-speed motor 64' which advances the web 10 in the direction of arrow 9. Such arrangement, combined with the provision of at least four irregularities on at least one of the discs 461–465, renders it possible to accelerate, to slow down, to arrest and/or to start the filter cigarette maker without affecting (or without unduly affecting) the quality of filter cigarettes which are being turned out while the maker is driven at a speed other than its normal opeating speed.

A feature of the improved method resides in the provision of steps of employing at least two different types of adhesive and utilizing an applicator which is constructed and assembled to apply different adhesives to different sections or portions of each uniting band of the running web, i.e., to each of a succession of web sections which constitute discrete uniting bands upon separation from the leader of the web.

The novel method renders it possible to apply different types of adhesive; this term is intended to encompass identical adhesives exhibiting different characterisics, e.g., as a result of injection of additives at 61, 62 and/or 63 as described with reference to and as shown in FIG. 5. Thus, the sections 53 of the running web 10 shown in FIG. 5 can be coated with an adhesive which contains materials and/or substances affecting the taste and/or aroma of the part of the mouthpiece coming into actual contact with the lips of the smoker. On the other hand, the sections 51 of the web 10 shown in FIG. 5 (i.e., the sections which bond the mouthpieces to the respective plain cigarettes 7) can contain a flame or combustion retarding or preventing substance or a higher percentage of such substance than the adhesive films applied to other portion(s) of each uniting band.

A glow-preventing substance in the adhesive coating the sectons 51 of the web 10 shown in FIG. 5 can serve to prevent or to reduce the likelihood of development of glowing remnant of the inner end of the tobacco-containing portion of a filter cigarette; such embers could fall onto the carpet, onto a piece of furniture or onto the doting of the smoker and could start a fire or other damage.

It is also within the purview of our invention to rely upon a method which can be practiced with advantage by resorting to the apparatus of FIG. 1 or 5, namely to an apparatus wherein the number of sources of adhesive is less or much less than the number of nozzles. Thus, and referring again to FIG. 1, a single source 294 of adhesive can supply adhesive to three pumps (281–283), and these three pumps can meet the requirements of five nozzles (21, 121). If it should become necessary to change the composition and/or other characteristics of the adhesive being conveyed from the pumps 281–283 to the respective valves 26, one resorts to the injector 61 and/or 62 and/or 63 in order to introduce into the respective adhesive stream one or more additives which influence the existing characteristics or impart one or more characteristics to the adhesive which is to be discharged by the nozzle 121 and/or by one or more nozzles 21. It will be seen that the injectors 61–63 are installed ahead (upstream) of the valves 26. However, it is equaly possible to install the injector 61 and/or 62 and/or 63 even closer to the respective nozzle or nozzles e.g., if the additive is likely to evaporate (at least in part) prior to reaching the running web 10.

Another important advantage of the injectors is that they render it possible to reduce the overall dimensions of the improved adhesive applying apparatus. Thus, it suffices to resort to a single source (294) of adhesive rather than to two, three (see FIG. 5) or even more sources each of which can constitute a rather bulky vessel, tank or the like.

Compactness of a filter cigarette maker is a highly desirable and advantageous characteristic because, as a rule, such machine is but one of a series or group of machines which together form a production line normally employing a tobacco processing assembly arranged to supply properly prepared tobacco particles to a cigarette maker. The cigarette maker converts the tobacco particles into a continuous rod-like filler which is draped into a web of cigarette paper to yield a continuous cigarete rod. The rod is subdivided into a series of plain cigarettes of unit length or multiple unit length which are fed into a filter cigarette maker. The latter further receives filter rod sections of unit length or multiple unit length from a filter rod making machine which, in many respects, resembles a cigarette maker, e.g., a cigarette maker known as GARANT and distributed by the assignee of the present application. The filter rod maker can be of the type disclosed, for example, in U.S. Pat. No. 4,412,505 granted Nov. 1, 1983 to Hüsler et al. for "APPARATUS FOR APPLYING ATOMIZED LIQUID TO A RUNNING LAYER OF FILAMENTARY MATERIAL OR THE LIKE". A GARANT-type cigarette maker is disclosed, for example, in U.S. Pat. No. 4,281,670 granted Aug. 4, 1981 to Heitmann et al. for "APPARATUS FOR INCREASING THE PERMEABILITY OF WRAPPING MATERIAL FOR RODSHAPED SMOKERS' PRODUCTS". As concerns the filter cigarette maker which can be utilized in the aforedescribed productino line, reference may be had, for example, to the aforementioned U.S. Pat. No. 5,135,008 to Oesterling et al.

Finished filter cigarettes are supplied to a packing machine which, in turn, delivers soft cigarette packs, so-called hinged-lid packs or other types of packs to a machine wherein the packs are confined in transparent envelopes prior to being admitted into a carton filling machine.

The invention also relates to a web of wrapping material which can be utilized with particular advantage for the making of filter cigarettes and carries one or more strips or otherwise configurated continuous or discontinuous layers or films of adhesive. The adhesive is a flame retardant or a flame preventing or extinguishing substance or contains metered quantities of such substance.

Another novel feature of the improved web is that it carries or can carry one or more films containing several types of adhesive, e.g., an adhesive which is a flame retardant, at least one adhesive which imparts a particular taste or flavor, and so forth.

Still further, the invention encompasses rod-shaped smokers' products (such as filter cigarettes, cigars or cigarillos) which exhibit at least one, at least two or more than two (such as all) of the aforediscussed novel characteristics. The adhesive which can be applied to the web of tipping paper or the like can be of a pasty or any other consistency which is suitable for the application to a running web by resorting to the methods and/or to the apparatus of the present invention.

The exact viscosity of the adhesive in the sources 291–294 will depend upon the nature of the web and/or upon the characteristics of the devices (such as pumps, valves, nozzles and the like) which are utilized to prepare, to store, to convey and to apply the adhesive to a running web of tipping paper or the like.

Figure 6:
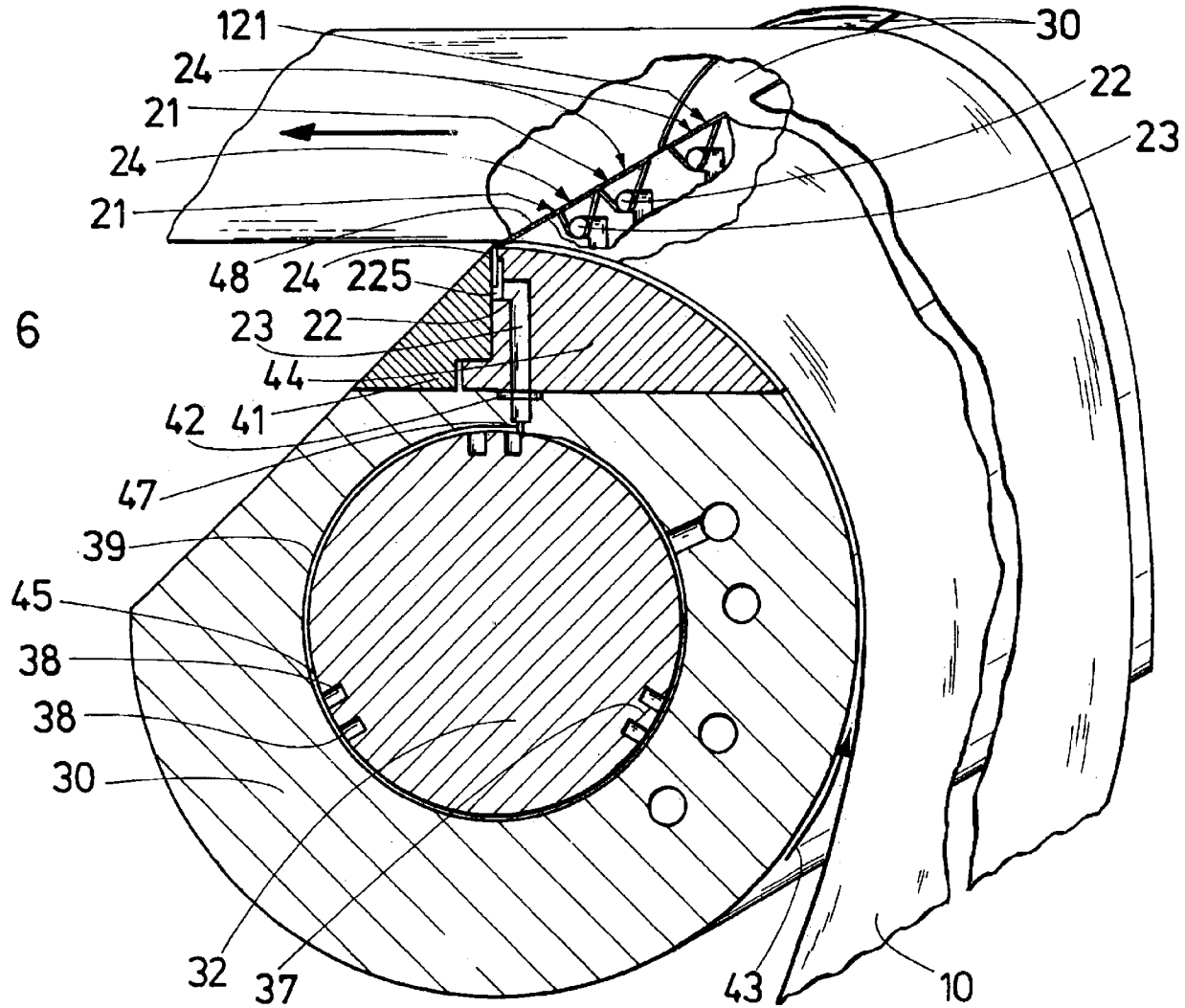
FIG. 6 is an enlarged fragmentary perspective view of a structure somewhat similar to that shown in FIGS. 3 and 4 but depicting a somewhat different valve and modified nozzles.

The only chamber 225 which is shown in FIG. 6 is different from those shown at 25 in FIGS. 1, 3 and 4, namely the chamber 225 is higher and overlies the radially inner part of the respective orifice 24. The width of each orifice 24 is between 6 and 12 mm, and its depth is or approximates 0.15 mm. The stator 30 is made of stainless steel and its peripheral surface 43 guides the running web 10. The surface 43 is coated with a substance which prevents adherence of adhesive to the stator 30.

FIG. 6 further shows a control bore 47 about 2 mm deep and about 0.6 mm wide. This bore allows for more accurate regulation of the delivery of adhesive to the orifices 24. Thus, and since the cross-sectional area of the bore 47 is relatively small, it permits for more accurate regulation of the flow of adhesive to the nozzles 21 and 121. The reference character 48 denotes the tear-off edge which is located immediately downstream of the nozzles 21, 121.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of making filter cigarettes and the like and, therefore, such adaptations should and are intended to be comprehended within the meaning and range of equivalence of the appended claims.

What is claimed is:

1. Apparatus for applying a flowable adhesive to selected portions of a running web of wrapping material for smokers' products, comprising:

at least one source of adhesive;

an applicator having at least one adhesive-discharging orifice adjacent a course for the running web;

means for connecting said at least one source with said applicator; and means for regulating—including interrupting—the flow of adhesive in said connecting means, comprising at least one rotary valve, wherein said at least one rotary valve has a peripheral surface and a plurality of rotary section having at least one irregularity on the peripheral surface.

2. The apparatus of claim 1, wherein said at least one valve includes a valve body and at least one rotor disposed in and having the peripheral surface defining with said body at least one arcuate path for the flow of adhesive from an inlet to an outlet of said at least one valve, said peripheral surface including the at least one irregularity arranged to influence the flow of adhesive from said inlet to said outlet.

3. The apparatus of claim 2, wherein said at least one irregularity includes at least one of (a) at least one recess, (b) at least one groove, (c) at least one projection, and (d) at least one lobe.

4. The apparatus of claim 2, wherein said body includes a housing having a chamber for said at least one rotor.

5. The apparatus of claim 1, wherein said applicator has at least one adhesive storing chamber communicating with said at least one orifice.

6. The apparatus of claim 1, wherein said at least one orifice has at least one parameter, including the depth and the capacity thereof, which is variable to thus influence the quantity of adhesive being applied to the web by said applicator.

7. The apparatus of claim 1, wherein said orifice is adjustable.

8. The apparatus of claim 1, wherein said applicator has a first width, said at least one orifice has a second width, and at least one of said widths is adjustable.

9. The apparatus of claim 1, wherein said applicator has an arcuate web-contacting surface adjacent said course for the web.

10. The apparatus of claim 1, further comprising means for varying the pressure of adhesive in said connecting means.

11. The apparatus of claim 1, wherein said applicator includes a plurality of nozzles each having at least one adhesive-discharging orifice adjacent said course for the web, said connecting means including discrete conduits each connecting said at least one source with a different one of said nozzles, and further comprising means for individually selecting the pressure of adhesive in at least two of said conduits.

12. The apparatus of claim 1, wherein said applicator includes at least two nozzles each having at least one adhesive-discharging orifice adjacent said course, said connecting means including at least two conduits each connecting said at least one source with a different one of said nozzles, and further comprising means for maintaining the pressure of adhesive in one of said at least two conduits at a value which at least approximates the pressure of adhesive in the other of said at least two conduits.

13. The apparatus of claim 12, wherein said connecting means further includes an additional conduit communicating with said at least one source, said at least two conduits having inlets communicating with said additional conduit and said pressure maintaining means including at least one pump disposed in said additional conduit upstream of said inlets of said at least two conduits.

14. The apparatus of claim 1, wherein at least a portion of said applicator has a coat of a material opposing accumulations of adhesive on the applicator.

15. The apparatus of claim 1, further comprising means for monitoring at least one variable parameter of adhesive on the web.

16. The apparatus of claim 15, wherein said monitoring means includes means for ascertaining the quantity of adhesive being applied to the web.

17. The apparatus of claim 15, wherein said monitoring means includes means for generating signals denoting the monitored at least one parameter, and further comprising means for adjusting at least one of said source, said applicator, said connecting means and said regulating means as a function of said signals.

18. The apparatus of claim 1, wherein said applicator comprises a plurality of nozzles each having at least one orifice and said regulating means comprises a rotary valve for each of said nozzles, each of said valves including a valve body and a rotor disposed in and having the peripheral surface defining with said body at least one arcuate path for the flow of adhesive from an inlet to an outlet of the respective valve, said peripheral surface of each rotor including the at least one irregularity arranged to influence the flow of adhesive from the inlet to the outlet of the respective valve.

19. The apparatus of claim 18, wherein each of said peripheral surfaces is provided with a plurality of irregularities.

20. The apparatus of claim 1, further comprising means for advancing the web along said course at a first speed, means for rotating a rotor of said at least one valve at a second speed, and means for synchronizing the operation of said advancing means with the operation of said rotating means.

21. The apparatus of claim 1, comprising at least two sources respectively containing different first and second adhesives, said application including first and second nozzles each having at least one orifice adjacent said course for the web and said connecting means including at least one first conduit arranged to convey first adhesive from the respective source to said first nozzle and at least one second conduit arranged to convey second adhesive from the respective source to said second nozzle.

22. The apparatus of claim 1, wherein said valve has a hollow stator and a rotor rotatable in said stator about a predetermined axis, said stator and said rotor defining an arcuate groove disposed in a plane normal to said axis and extending from an inlet to an outlet of said valve.

23. The apparatus of claim 22, wherein said groove extends along an arc approximating but less than 360°.

24. The apparatus of claim 1, wherein said applicator includes a plurality of nozzles each having at least one orifice and each adjacent a different portion of said course, said connecting means including a plurality of conduits, at least one for each of said nozzles and each connecting said source with the respective nozzle.

25. The apparatus of claim 24, wherein said source includes a plurality of discrete sources of different adhesives, said conduits including at least two conduits connecting one of said discrete sources with the respective nozzles.

26. The apparatus of claim 24, wherein said regulating means includes a plurality of valves each having a hollow body and a rotor turnable in the respective body about a predetermined axis, each rotor having a peripheral surface defining with the respective body a path leading to one of said nozzles, said bodies and said rotors cooperating to confine the adhesive to flow to the respective nozzles.

27. The apparatus of claim 26, wherein said rotors constitute substantially disc-shaped sections of a rotor which is common to all of said valves, said hollow bodies forming part of a stator common to and surrounding all of said disc-shaped sections, the peripheral surface of each of said disc-shaped sections having at least one irregularity arranged to influence the flow of adhesive within the respective hollow body.

28. The apparatus of claim 27, wherein at least one of said disc-shaped sections cooperates with the respective hollow body to establish a seal against leakage of adhesive from the respective valve.

29. The apparatus of claim 26, wherein said hollow bodies have internal surfaces surrounding said rotor and provided with arcuate grooves for the flow of adhesive along the respective paths, said grooves having centers of curvature on said axis.

30. The apparatus of claim 29, wherein at least one of said grooves extends along an arc approximating but less than 360°.

31. The apparatus of claim 24, wherein at least one of said nozzles has at least one adhesive-storing chamber communicating with the respective at least one orifice.

* * * * *